US005096515A

United States Patent [19]

Kawamura et al.

[11] Patent Number: 5,096,515

[45] Date of Patent: Mar. 17, 1992

[54] HIGH STRENGTH HIGH CHROMIUM CAST IRON AND VALVE ROCKER ARM MADE THEREOF

[75] Inventors: Osamu Kawamura; Teruo Takahashi, both of Saitama; Makoto Kano; Ichiro Tanimoto, both of Kanagawa, all of Japan

[73] Assignees: Nippon Piston Ring Co., Ltd., Tokyo; Nissan Motor Company, Limited, Yokohama, both of Japan

[21] Appl. No.: 442,279

[22] Filed: Nov. 28, 1989

[30] Foreign Application Priority Data

Nov. 28, 1988 [JP] Japan ..... 63-301263

[51] Int. Cl.[5] ..... C22C 37/04; C22C 37/06

[52] U.S. Cl. ..... 148/326; 148/324; 148/325

[58] Field of Search ..... 148/324, 326, 325; 420/16, 17

[56] References Cited

U.S. PATENT DOCUMENTS

| | | | |
|---|---|---|---|
| 3,410,682 | 11/1968 | Avery et al. | 420/16 |
| 3,690,958 | 9/1972 | Thompson | 148/324 |
| 4,411,713 | 10/1983 | Betts | 148/324 |
| 4,547,221 | 10/1985 | Norman et al. | 420/16 |

FOREIGN PATENT DOCUMENTS

| | | |
|---|---|---|
| EP-A-0 061235 | 9/1982 | European Pat. Off. . |
| DE-B 1483175 | 4/1971 | Fed. Rep. of Germany . |
| SU-A 417524 | 11/1974 | U.S.S.R. . |
| GB-A- 2205108 | 11/1988 | United Kingdom . |

OTHER PUBLICATIONS

M. Kano and I. Tanimoto, "Wear Mechanism of High Wear-Resistant Materials for Automotive Valve Trains, Wear of Materials", ASME 1991, pp. 83-89.

*Primary Examiner*—Deborah Yee
*Attorney, Agent, or Firm*—Foley & Lardner

[57] ABSTRACT

A high strength high chromium cast iron contains fine particle precipitated hard carbide. The precipitated hard carbide has an average particle size of 20 μm or less and hardness of Hv 500 or more in martensite base matrix, and has area ratio in a range of 30% or more and 45% or less. The precipitated hard carbide has spheroidal ratio (surface area of sphere circumscribing the precipitated hard carbide versus actual surface area of precipitated hard carbide) of 40% or more.

10 Claims, 3 Drawing Sheets

50um (x200)

50um (x200)

50um (x200)

HIGH STRENGTH HIGH CHROMIUM CAST IRON AND VALVE ROCKER ARM MADE THEREOF

BACKGROUND OF THE INVENTION

1. Field of the Invention

The present invention relates generally to a high strength high chromium cast iron. The invention also relates to a valve rocker arm for an internal combustion engine of an automotive vehicle, which is made of the high strength high chromium cast iron.

2. Description of the Background Art

In an automotive internal combustion engine, a valve drive mechanism is provided for driving intake valves and exhaust valves in synchronism with engine revolution. The valve drive mechanism generally comprises a camshaft and a cam follower which convert rotation of the camshaft into a reciprocating motion for axially driving the intake and exhaust valves.

The cam follower comprises a valve rocker arms adapted to be driven by cams carried by the camshaft. The rocker arm is formed of aluminum alloy or high chromium cast iron. In case of aluminium alloy, the rocker arm is formed by die-casting. On the other hand, in case of high chromium cast iron, the rocker arm is formed by integral casting. According to advancing of automotive technologies for higher performance engine, requirement for compact and light weight engine with long life and maintenance free construction.

One example of high chromium cast iron rocker arm has been disclosed in Japanese Patent First (unexamined) Publication (Tokkai) Showa 56-84442. In this Japanese Patent First Publication, ferrochromium alloy used for high chromium cast, is composed of Cr, C, Si, Mn and so forth. In the disclosure, the ferrochromium alloy contains about 30 wt % of Cr with 9 to 13 of Cr/C composition ratio and with greater than or equal to 15 of Cr/C/S composition ratio. More specifically, the disclosed composition of the ferrochromium allow is as follow:

C: 2.4–3.2 Wt %
Si: 0.5–1.0 Wt %
Mn: less than 1.0 Wt %
Cr: 25–35 Wt %.

The high chromium cast iron randomly forms needle structure carbide precipitated on the surface which contacts with cam of a camshaft which is made of chilled cast iron valve shaft of intake and exhaust valve, pivot and so forth. Furthermore, the high chromium cast iron contains martensite base matrix, in which residual sustenite or ferrite is distributed. Such structure of cast iron can cause substantial wearing of the associated components, such as cam, valve shaft, pivot and so forth. On the other hand, the valve rocker arm per se can cause severe scarfing wearing.

SUMMARY OF THE INVENTION

Therefore, it is an object of the invention to provide a high strength high chromium cast iron which can solve the problems involved in the prior art.

Another object of the invention is to provide a high chromium cast iron which is suitable for forming a valve rocker arm in a valve drive mechanism of an automotive internal combustion engine, and which can reduce wearing at both of the rocker arm per se and associated components, such as cam, valve shaft, pivot and so forth.

In order to accomplish aforementioned and other objects, a high strength high chromium cast iron, according to the present invention, contains fine particle precipitated hard carbide. The precipitated hard carbide has an average particle size of 20 μm or less and hardness of Hv 500 or more in martensite base matrix, and has area ratio in a range of 30% or more and 45% or less. The precipitated hard carbide has spheroidal ratio (surface area of sphere circumscribing the precipitated hard carbide versus actual surface area of precipitated hard carbide) of 40% or more.

According to one aspect of the invention, a high chromium cast iron contains fine particle precipitated hard carbide which precipitated hard carbide has an average particle size of 20 μm or less and hardness of Hv 500 or more in martensite base matrix, and has area ratio in a range of 30% or more and 45% or less, and which precipitated hard carbide has spheroidal ratio of 40% or more.

Preferably, the material for the high chromium cast iron has chemical composition of:

C: 2.5–3.7 Wt %
Si: 1.0–2.0 Wt %
Mn: 0.5–1.0 Wt %
Cr: 15–20 Wt %
Ni: 0.3–0.7 Wt %
P: less than 3 Wt %
S: less than 0.1 Wt %
Fe: remainder and inevitable impurities.

If desired, the material of the high chromium cast iron may further contain one or more of the materials selected among W, Mo, V, Nb, Ta, Ti and B. In such case, it is preferable that the overall composition of these selected one or two materials is in a range of 3 to 10 Wt %.

According to another aspect of the invention, a rocker arm for an internal combustion engine for an automotive vehicle, made of a high chromium cast iron contains fine particle precipitated hard carbide which precipitated hard carbide has an average particle size of 20 μm or less and hardness of Hv 500 or more in martensite base matrix, and has area ratio in a range of 30% or more and 45% or less, and which precipitated hard carbide has spheroidal ratio of 40% or more.

BRIEF DESCRIPTION OF THE DRAWINGS

The present invention will be understood more fully from the detailed discussion given herebelow and from the examples given herebelow, which, however, should not be taken to limit the invention to the specific examplified compositions, but are for demonstration, explanation and understanding only.

In the drawings.

DETAILED DESCRIPTION OF THE INVENTION

Figure 1:
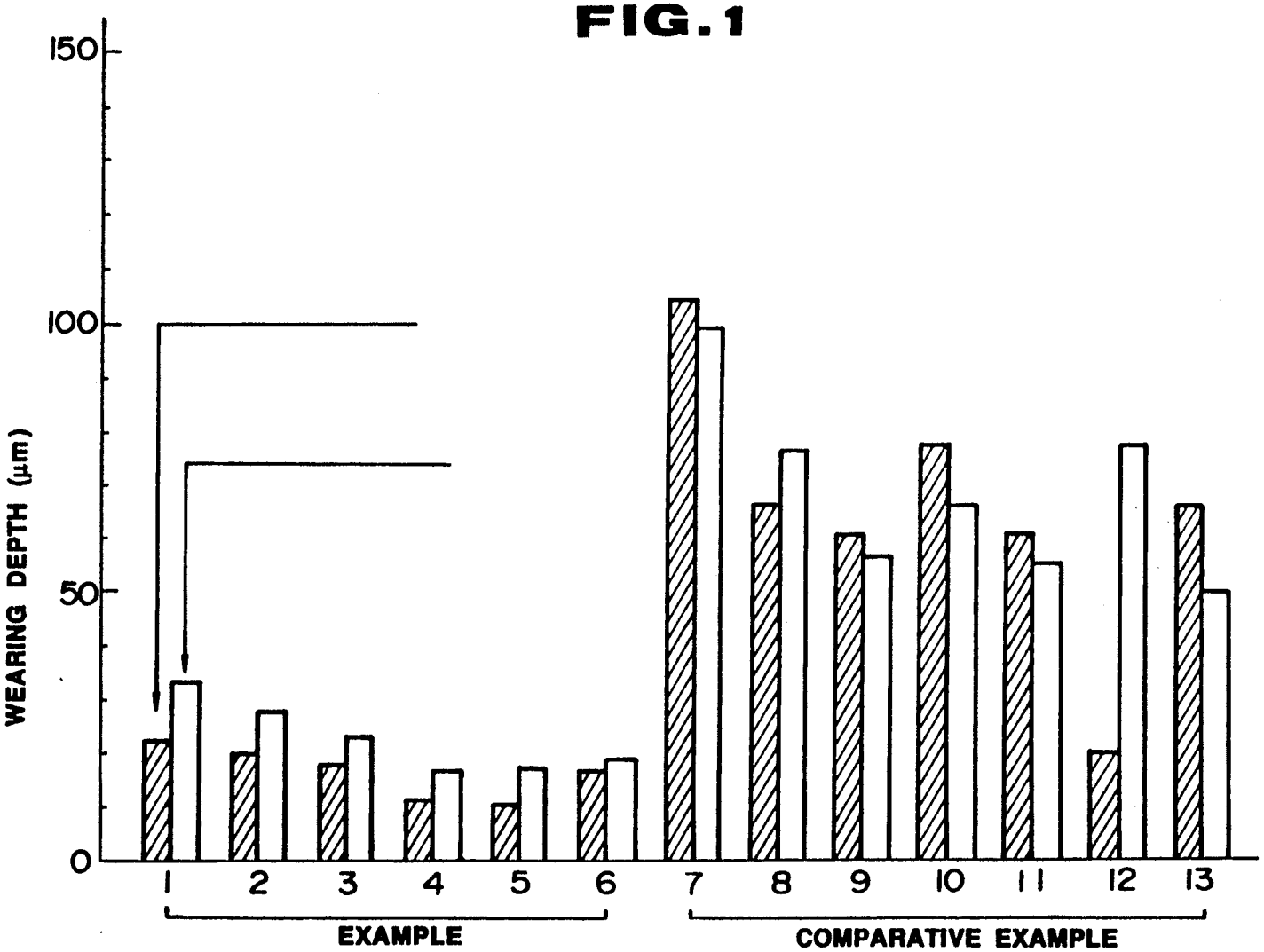
FIG. 1 is a graph showing results of endurance test performed for examples Nos. 1 through 8 and comparative examples 7 through 13.

As set forth above, the present invention is featured by a high strength high chromium cast iron contains fine particle precipitated hard carbide. The precipitated hard carbide has an average particle size of 20 μm or less and hardness of Hv 500 or more in martensite base matrix, and has area ratio in a range of 30% or more and 45% or less. The precipitated hard carbide has spheroidal ratio (surface area of sphere circumscribing the precipitated hard carbide versus actual surface area of precipitated hard carbide) of 40% or more. Furthermore, the invention further features a valve rocker arm of a valve drive mechanism of an internal combustion engine of an automotive vehicle.

When the average particle size of the hard carbide is greater than 20 μm, drop out of the precipitated hard carbide can be caused or substantial wearing of the associated compoment, such as a cam of a camshaft, which is made of chilled cast iron, valve shaft, pivot and so forth. Therefore, it is not desirable to make the average particle size greater than 20 μm. On the other hand, when the hardness of martensite base matrix is lower than Hv 500, soarfing wearing can be easily caused to promote wearing not only on the rocker arm but also on the cam, valve shaft, pivot and so forth.

On the other hand, if the area ratio of the precipitated hard carbide is less than 30%, uniformity of distribution of the hard carbide is destroyed for causing local wearing in the associated components and thus promote greater magnitude of wearing. On the other hand, if the area surface of the hard carbide becomes greater than 45%, toughness or strength of the rocker arm is lowered. Furthermore, such too hard rocker arm mat attack the associated components. Therefore, the area ratio of the hard carbide is preferred to be in a range of 30% or more but not greater than 45%. In addition, when the spheroidal ratio is less than 40%, the needle hard carbide structure is increased to attack against the material of the associated components to promote greater magnitude of wearing.

In order to achieve the property of the high chromium cast iron, the preferred composition of the material is as follow:

C: 2.5–3.7 Wt %
Si: 1.0–2.0 Wt %
Mn: 0.5–1.0 Wt %
Cr: 15–20 Wt %
Ni: 0.3–0.7 Wt %
P: less than 3 Wt %
S: less than 0.1 Wt %
Fe: remainder and inevitable impurities.

The composition may further includes one or two of the materials selected among W, Mo, V, Nb, Ta, Ti and B. The overall composition of these selected one or two materials is in a range of 3 to 10 Wt %.

C is a material effective for improving wear resistance of the cast iron, in a form of the rocker arm. When too small amount of C is contained, the area ratio of the precipitated hard carbide becomes smaller than 30% to make the wear resistance of the rocker arm per se unacceptably low. This results in causing wearing of the associated components. In view of this, the content of C should be greater than or equal to 2.5 Wt %. Contrary to this, when the content of C becomes excessive, the area ratio of the hard carbide to be precipitated becomes greater than 45% to cause lowering of toughness or strength. In view of this, the C content is limited at 3.7 Wt %.

If the Si content is less than 1 Wt %, the melting temperature of the molten iron becomes unacceptably high to cause misrun in casting. On the other hand, when the Si content is greater than 2.0 Wt %, the excess amount of Si may prevent the hard carbide from being precipitated and precipitate graphite to cause lowering of wear resistance. In view of these, the preferred range of Si content is set in a range of 0.1 to 2.0 Wt %.

A part of the Mn component for forming carbide and another part serves for forming solid solution for promoting formation of pearlite and improving hardenability. When the content of Mn is less than 0.5 Wt %, the effect of Mn cannot be obtained. On the other hand, if the content of Mn becomes greater than 1.0 Wt %, too much amount of carbide is precipitate for lowering of toughness. For instance, in case that the base matrix is martensite, too much amount of carbide may cause temper brittleness. Therefore, preferred range of Mn content is within a range of 0.5 to 1.0 Wt %.

Cr is effective for formation of various carbide and is further effective for forming high density oxide layer on the rocker arm surface for improving corrosion resistance and wear resistance of the rocker arm. If the Cr content is too small, the precipitated hard carbide $(Fe, Cr)_7C_3$, becomes unacceptably small to make distribution of the hard carbide becomes uneven or non-uniform. This results in lack of wear resistance of the rocker arm and thus causes wearing in the associated components. Therefore, the preferred content of the Cr is greater than equal to 15 Wt %. On the other hand, when excess amount of Cr is contained, austenite or ferrite is remained in the martensite base matrix for causing severe scarfing not only in the rocker arm per se and the associated components, such as cam, valve shaft, pivot and so forth. In order to avoid this, the content of Cr is less than or equal to 25 Wt %, preferably 20 Wt %.

Ni is effective for improving toughness and hardenability. If the Ni content is too small, effect of improving toughness cannot be obtained. In order to obtain satisfactory toughness, Ni has to be contained in the content greater than or equal to 0.3 Wt %. On the other hand, if excess amount of Ni is contained, austenite in the martensite base material causes wearing. Therefore, the preferred content of Ni is less than or equal to 0.7 Wt %.

P resides in the cast iron structure in a form of hard steadite ($Fe$-$Fe_3C$-$Fe_3P$) and improves wear resistance of the rocker arm. When the P content becomes in excess of 0.3 Wt %, $Fe_3C$ in the steadite is increased to make the cast block hard and brittle. Therefore, it is preferred to maintain the content of P less than or equal to 0.3 Wt %. Also, S is preferred to be contained in amount less than or equal to 0.1 Wt %.

In addition, W, Mo, V, Nb, Ta, Tl and B can be added for forming hard carbide and thus improve wear resistance. Furthermore, these materials are effective for increasing spheroidal ratio for reducing property of attacking against the associated component. Therefore, selected one or two of these material can be added in amount 3 Wt %. However, when this material has a property of lowering of toughness of the cast block as the rocker arm if an excess amount is added. Therefore, the preferable content of the additive material is not more than 10 Wt %.

Utilizing the material composition, high chromium cast iron is casted by way of integral casting. After casting, the cast block is subjected to hardening and tempering so that the hardness Hv of the martensite base matrix is higher than or equal to 500. Subsequently, the cast block is further processed by machining for improving adhering resistance.

In order to confirm the improved property of the high chromium cast iron according to the invention, experiments were performed in terms of various examples. Furthermore, in order to compare with the results obtained from the examples, additional experiments were performed in terms of various comparative examples. Discussion concerning each example and comparative example will be given herebelow.

EXAMPLES

In the experiments, molten iron having chemical composition as shown in the appended table I. The molten iron were respectively processed by precision casting for forming rocker arm cast block. For the examples Nos. 1 through 6 and the comparative examples Nos. 8 through 10, 12 and 13, heat treatment, i.e. hardening and tempering process was performed. For the comparative examples Nos. 7 and 11, heat treatment was not performed. Subsequently, all of the examples and comparative examples are subject machining process to be finished into a desired configuration of rocker arm.

For respective samples of all examples and comparative examples, amount of precipitated hard carbide, particle size and spheroidal ratio were measured. Furthermore, the structure and hardness of the base matrix were also checked for respective samples. The results are listed on the table I. Furthermore, by installing respective sample rocker arms of respective examples and comparative examples, endurance test was performed. The endurance test was performed in the condition set out in the appended table II. After endurance test, depth of wearing in the rocker arm and the cam nose as the associated component was measured. The result of measurement is illustrated in FIG. 1.

As can be seen from the table I and FIG. 1, since the comparative example No. 7 has Cr content, residual austenite is contained in martensite base matrix. Furthermore, since the comparative examine No. 7 is not subject heat treatment, hardness of the martensite base material is low. In addition, since the comparative example No. 7 does not contain W, Mo or so forth, spheroidal ratio of the precipitated carbide is substantially low. ;urthermore, the particle size of the precipitated carbide is relatively large. In the comparative example, severe scarfing was observed on both of the rocker arm and the cam nose. From this, it was found that were resistance of the comparative example is insufficient.

Figure 2:
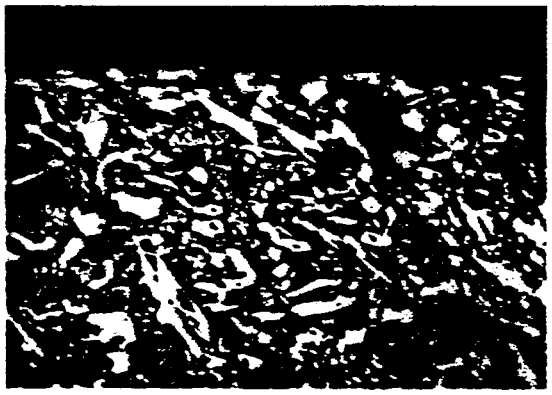
FIGS. 2 through 5 are photomicrographs showing structure of comparative examples No. 7, 10 and 12 and example No. 4.

For the comparative example, structure in the section was observed. Microphotograph of the section of the comparative example No. 7 is shown in FIG. 2. In fig. 2, the white block is carbide. As can be seen, the white carbide is in needle form structure. In the microphotograph, gray section is residual austenite. As can be clear from FIG. 2, since the comparative example No. 7 contains more than 20 Wt % of Cr, austenite and ferrite reside in the martensite base matrix which has relatively low hardness. For this reason, it can be appreciated that the comparative example No. 7 is easy to cause scarfing wearing.

On the other hand, absence of carbide of W, Mo or so forth, the precipitated carbide $(Fe, Cr)_7C_3$. $(Fe,Cr)_{23}C_6$ is in a structure of needle and has large particle size. Because of large particle size and low spheroidal ratio, the cam nose as associated component and made of chilled casting was seriously attacked to cause great magnitude of wearing.

The comparative example No. 8 is differentiated from the comparative example No. 7 only in heat treatment in preparation. Since the comparative example No. 8 has martensite base matrix having higher hardness than that of the comparative example No. 7, wearing magnitude is smaller than that of the comparative example No. 7. However, since residual austenite is present in the martensite base matrix, the particle size of the precipitated carbide is relatively large and the spheroidal ratio is relatively low, scarfing wearing is observed. Therefore, even in the comparative example 8, because of presence of residual austenite after heat treatment due to Cr content greater than 20 Wt %, scarfing is caused. Furthermore, since the structure of the carbide is needle structure similarly to that of the comparative example No. 7, it attacks the associated component, i.e. cam nose, for causing substantial wearing.

The comparative example No. 9 also contains more than 20 Wt % of Cr. Therefore, the martensite base matrix still contains residual austenite. In this comparative example No. 9, severe scarfing was observed. The comparative example No. 9 contains W and Mo in chemical composition. Therefore, the precipitated carbide $(Fe,Cr)_7C_3$. $(Fe,Cr)_{23}C_8$, has higher spheroidal ratio and smaller particle size in comparison with that of the comparative examples Nos. 7 and 8. Therefore, wearing on the cam nose was much smaller than the foregoing comparative examples 7 and 8.

Figure 3:
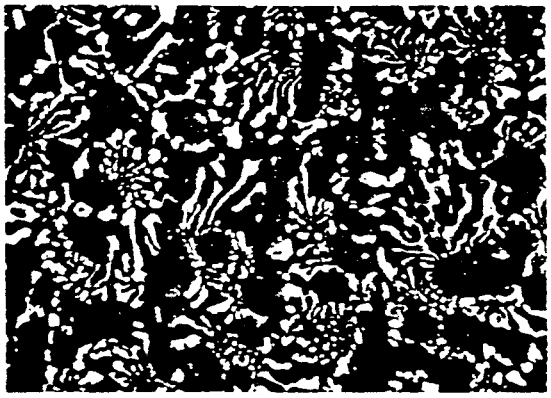

The comparative example No. 10 has Cr content less than 15 Wt %. As a result, smaller amount of carbide $(Fe,Cr)_7C_3$ precipitated. Section of the comparative example No. 10 is shown in FIG. 3. In FIG. 3, the white block is carbide, grey section is martensite matrix. As can be seen, the density of the precipitated carbide is relatively low. As a result, wear resistance of the rocker arm become insufficient. Due to occurrence of wearing at the rocker arm, the associated component was also worn.

The comparative example No. 11 was prepared by directly performing machining process for the rocker arm cast block without performing heat treatment. Therefore, this rocker arm is insufficient in hardness. Also, the martensite base matrix has low hardness. Therefore, this comparative example No. 11 shows low adhering resistance. Furthermore, this comparative example is easy to cause scarfing.

Figure 4:
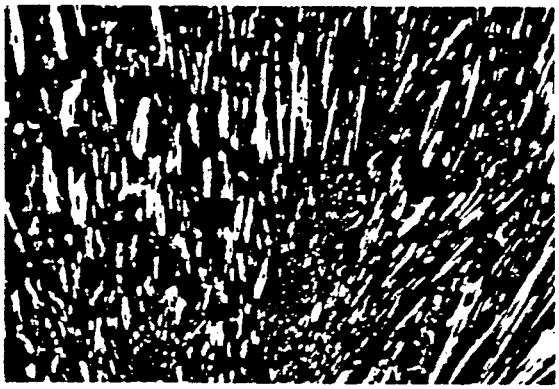

The comparative example No. 12 contains too small amount of W, Mo or so forth. The section is shown in a form of microphotograph in FIG. 4. In FIG. 4, the white block is carbide and black section is martensite matrix. The spheroidal ration of this comparative example 12 was 25% and substantially in needle structure. Therefore, though wearing magnitude of the rocker arm is relatively small, great magnitude of wearing was caused in the associated cam nose.

The comparative example No. 13 contains small amount of C. Therefore, area ratio of precipitated carbide is 27%. This makes the wear resistance of the rocker arm unacceptable low.

Figure 5:
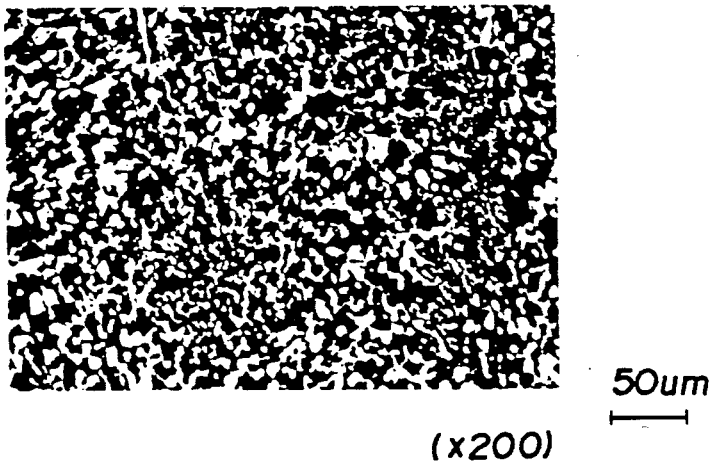

In contrast to these comparative examples, the examples Nos. 1 through 6 shows good and satisfactory wear resistance. FIG. 5 shows the microphotograph of the example No. 4. In the structure shown in FIG. 5, the average particle size of the precipitated carbide was 16 μm. The area ratio of the carbide was 37% and the hardness Hv of the martensite base material was 738. This shows substantially small magnitude of wearing as shown in the table I and thus exhibits satisfactorily high wear resistance.

Therefore, the present invention fulfills all of the objects and advantages sought therefor.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE I

| | Chemical Composition (wt %) | | | | | | | | | Heat Treatment Y: Performed N: Not | Hard Carbide | | | Matrix | | |
|---|---|---|---|---|---|---|---|---|---|---|---|---|---|---|---|---|
| | Cr | C | Si | Mn | Ni | P | S | W | Others | | Area Ratio (%) | Particle Size (μm) | Spheroidal Ratio (%) | Composition | Hardness (HMV) | Drawing |
| Exam. 1 | 16 | 2.5 | 1.2 | 0.7 | 0.3 | 0.10 | 0.05 | 3.0 | — | | 32 | 20 | 40 | Martensite | 725 | — |
| Exam. 2 | 16 | 3.0 | 1.6 | 0.7 | 0.4 | 0.10 | 0.05 | 5.0 | — | | 34 | 18 | 42 | Martensite | 730 | — |
| Exam. 3 | 17 | 3.3 | 1.6 | 0.6 | 0.5 | 0.10 | 0.04 | 4.0 | Mo: 1.6 | | 35 | 17 | 43 | Martensite | 732 | — |
| Exam. 4 | 18 | 3.5 | 1.7 | 0.7 | 0.6 | 0.10 | 0.05 | 5.0 | Me: 1.2 | | 37 | 16 | 43 | Martensite | 738 | FIG. 5 |
| Exam. 5 | 19 | 3.4 | 1.6 | 0.6 | 0.6 | 0.06 | 0.04 | 4.0 | Mb: 1.0 | | 38 | 15 | 44 | Martensite | 735 | — |
| Exam. 6 | 20 | 3.7 | 1.9 | 0.8 | 0.7 | 0.20 | 0.08 | 9.0 | V: 1.0 | | 42 | 11 | 45 | Martensite | 741 | — |
| Comp. 7 | 27 | 2.9 | 0.5 | 1.2 | — | 0.05 | — | — | — | | 44 | 30 | 25 | M: Martensite<br>γ: Residual Austenite | M: 485<br>γ: 350 | FIG. 2 |
| Comp. 8 | 27 | 2.9 | 0.5 | 1.2 | — | 0.05 | 0.05 | — | — | | 44 | 30 | 25 | M: Martensite<br>γ: Residual Austenite | M: 720<br>γ: 370 | — |
| Comp. 9 | 24 | 3.8 | 1.5 | 0.7 | 0.7 | 0.10 | 0.05 | 5.0 | Me: 1.0 | | 42 | 18 | 44 | M: Martensite<br>γ: Residual Austenite | M: 735<br>γ: 340 | — |
| Comp. 10 | 12 | 3.0 | 1.6 | 0.7 | 0.6 | 0.10 | 0.05 | 5.0 | Mo: 1.0 | | 25 | 17 | 41 | Martensite | 732 | FIG. 3 |
| Comp. 11 | 18 | 3.4 | 1.7 | 0.5 | 0.6 | 0.05 | 0.05 | 5.0 | Me: 1.2 | | 37 | 15 | 45 | Martensite | 470 | — |
| Comp. 12 | 18 | 3.5 | 1.7 | 0.7 | 0.7 | 0.10 | 0.04 | 2.2 | — | | 40 | 20 | 25 | Martensite | 725 | FIG. 4 |
| Comp. 13 | 18 | 2.0 | 1.7 | 0.8 | 0.8 | 0.10 | 0.05 | 5.0 | Me: 1.0 | | 27 | 15 | 40 | Martensite | 718 | — |

TABLE II

| Item | Condition |
|---|---|
| Engine | In-Line 4 Cylinder Gasoline Engine (O.H.C. 2000 cc) |
| Drive System | Motering |
| Valve Spring Load | 20% higher than Standard |
| Cam Shaft | Chilled Casting |
| Engine Oil | 75W-30 |
| Engine Speed | 600 r.p.m. |
| Endurance Period | 500 h |

It is claimed:

1. A high chromium cast iron comprising fine particle precipitated hard carbide, wherein said precipitated hard carbide has an average particle size of 20 μm or less, a hardness of Hv 500 or more in a martensite base matrix an area ratio of 30% to 45% and a spheroidal ratio of 40% or more.

2. A high chromium cast iron as set forth in claim 1, further comprising a composition of:
C: 2.5–3.7 Wt %
Si: 1.0–2.0 Wt %
Mn: 0.5–1.0 Wt %
Cr: 15–20 Wt %
Ni: 0.3–0.7 Wt %
P: less than 3 Wt %
S: less than 0.1 Wt %
Fe: remainder.

3. A high chromium cast iron as set forth in claim 2, further comprising 3 to 10 weight percent of at least one component selected from the group consisting of W, Mo, V, Nb, Ta, Ti and B.

4. A rocker arm for a internal combustion engine for an automotive vehicle, comprising a high chromium cast iron comprising fine particle precipitated hard carbide, wherein said precipitated hard carbide has an average particle size of 20 μm or less, a hardness of Hv 500 or more in a martensite base matrix, an area ratio of 30% to 45% and a spheroidal ratio of 40% or more.

5. A rocker arm as set forth in claim 4, wherein said high chromium cast iron further comprises a composition of:
C: 2.5–3.7 Wt %
Si: 1.0–2.0 Wt %
Mn: 0.5–1.0 Wt %
Cr: 15–20 Wt %
Ni: 0.3–0.7 Wt %
P: less than 3 Wt %
S: less than 0.1 Wt %
Fe: remainder.

6. A rocker arm as set forth in claim 5, wherein said high chromium cast iron further comprises 3 to 10 weight percent of at least one component selected from the group consisting of W, Mo, V, Nb, Ta, Ti and B.

7. A high chromium cast iron according to claim 2, wherein less than 0.3 wt. % of said P is present.

8. A rocker arm according to claim 5, wherein less than 0.3 wt. % of said P is present.

9. A high chromium cast iron as set forth in claim 3 wherein said further component consists of W.

10. A rocket arm as set forth in claim 6 wherein said further component consists of W.

* * * * *